US010838324B2

(12) United States Patent
Sabo et al.

(10) Patent No.: US 10,838,324 B2
(45) Date of Patent: Nov. 17, 2020

(54) DEVELOPER ROLLER FOR LIQUID ELECTROPHOTOGRAPHIC PRINTING

(71) Applicant: HP Indigo B.V., Amstelveen (NL)

(72) Inventors: David Sabo, San Diego, CA (US); Guang Jin Li, San Diego, CA (US); Stanley J. Kozmiski, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/346,297

(22) PCT Filed: Jan. 20, 2017

(86) PCT No.: PCT/EP2017/051204

§ 371 (c)(1),
(2) Date: Apr. 30, 2019

(87) PCT Pub. No.: WO2018/133946

PCT Pub. Date: Jul. 26, 2018

(65) Prior Publication Data

US 2019/0332037 A1 Oct. 31, 2019

(51) Int. Cl.
*G03G 15/08* (2006.01)
*G03G 15/10* (2006.01)

(52) U.S. Cl.
CPC ..... *G03G 15/104* (2013.01)

(58) Field of Classification Search
USPC ..... 399/239
See application file for complete search history.

(56) References Cited

U.S. PATENT DOCUMENTS

| | | | | |
|---|---|---|---|---|
| 5,666,615 | A * | 9/1997 | Nguyen | G03G 15/101 399/240 |
| 6,137,986 | A | 10/2000 | Sugino et al. | |
| 7,221,889 | B2 | 5/2007 | Patton et al. | |
| 7,693,461 | B2 | 4/2010 | Lee et al. | |
| 8,118,421 | B2 | 2/2012 | Badesha et al. | |
| 8,594,535 | B2 | 11/2013 | Garcia | |
| 9,434,152 | B2 | 9/2016 | Williams et al. | |
| 2010/0215405 | A1 | 8/2010 | Patton et al. | |
| 2011/0275502 | A1 | 11/2011 | Eichhorn et al. | |
| 2012/0027468 | A1 | 2/2012 | Nelson et al. | |
| 2015/0227074 | A1* | 8/2015 | Ito | G03G 15/75 252/500 |

FOREIGN PATENT DOCUMENTS

JP 55050280 A 4/1980

* cited by examiner

*Primary Examiner* — Quana Grainger
(74) *Attorney, Agent, or Firm* — Dierker & Kavanaugh PC

(57) ABSTRACT

In one example, a developer roller for liquid electrophotographic printing includes a cylindrical metal inner core, a rigid conductive plastic outer core surrounding the inner core, and a compliant exterior surrounding the outer core.

14 Claims, 5 Drawing Sheets

DEVELOPER ROLLER FOR LIQUID ELECTROPHOTOGRAPHIC PRINTING

BACKGROUND

Liquid electro-photographic (LEP) printing uses a special kind of ink to form images on paper and other print substrates. LEP ink usually includes charged polymer particles dispersed in a carrier liquid. The polymer particles are sometimes referred to as toner particles and, accordingly, LEP ink is sometimes called liquid toner. LEP ink may also include a charge control agent to help control the magnitude and polarity of charge on the particles. An LEP printing process involves placing an electrostatic pattern of the desired printed image on a photoconductor and developing the image by presenting a thin layer of LEP ink to the charged photoconductor. The ink may be presented to the photoconductor with a roller that is commonly referred to as a "developer roller." Charged toner particles in the ink adhere to the pattern of the desired image on the photoconductor. The ink image is transferred from the photoconductor to a print substrate, for example through a heated intermediate transfer member that evaporates much of the carrier liquid to dry the ink film, and then to the print substrate as it passes through a nip between the intermediate transfer member and a pressure roller

DRAWINGS

The same part numbers designate the same or similar parts throughout the figures. The figures are not necessarily to scale.

DESCRIPTION

In liquid electrophotographic printing, a thin film of LEP ink is applied to the exterior of a developer roller and then presented to a photoconductor at a nip between the developer roller and the photoconductor. Some LEP printers use a developer roller that includes an aluminum or steel core covered by a polyurethane exterior. Polyurethane formed around an aluminum or steel core is susceptible to depolymerization caused by unwanted ion migration. Electroless nickel plating may be used to minimize the risk of depolymerization. Even with nickel plating, however, the polyurethane exterior is still susceptible to depolymerization, particularly in hot, humid environments. Also, polyurethane does not adhere well to electroless nickel plating, making the polyurethane exterior sensitive to detaching from the core. Consequently, for better adhesion the polyurethane exterior is wrapped around the ends of the core. The corner at each of end of the metal core is rounded to accommodate the polyurethane wrap. The rounded corners weaken the electric field at the ends of the roller, which shortens the usable length of the roller.

A new developer roller for liquid electrophotographic printing has been developed in which a layer of rigid conductive plastic is sandwiched between a metal core and a polyurethane exterior to improve adhesion and to reduce depolymerization of the polyurethane, without degrading the mechanical or electrical characteristics of the roller. In one example, a carbon fiber filled polyphenylene sulfide (PPS) or other suitably rigid plastic is formed directly on a metal core and then a polyurethane exterior is applied directly to the plastic. The plastic provides good adhesion for the polyurethane exterior without the risk of ion migration that can cause depolymerization, and the carbon fiber fill and intimate contact of the plastic with the metal core provides good core conductivity and mechanical strength. Also, the better adhesion of the polyurethane to the plastic allows a sharper corner at the ends of the core, extending the usable length of the roller.

This and other examples shown in the figures and described below illustrate but do not limit the scope of the patent, which is defined in the Claims following this Description.

As used in this document, "conductive" means having a resistivity below 1 kΩ-cm; and "resistive" means having a resistivity of at least 10 kΩ-cm.

Figure 1:
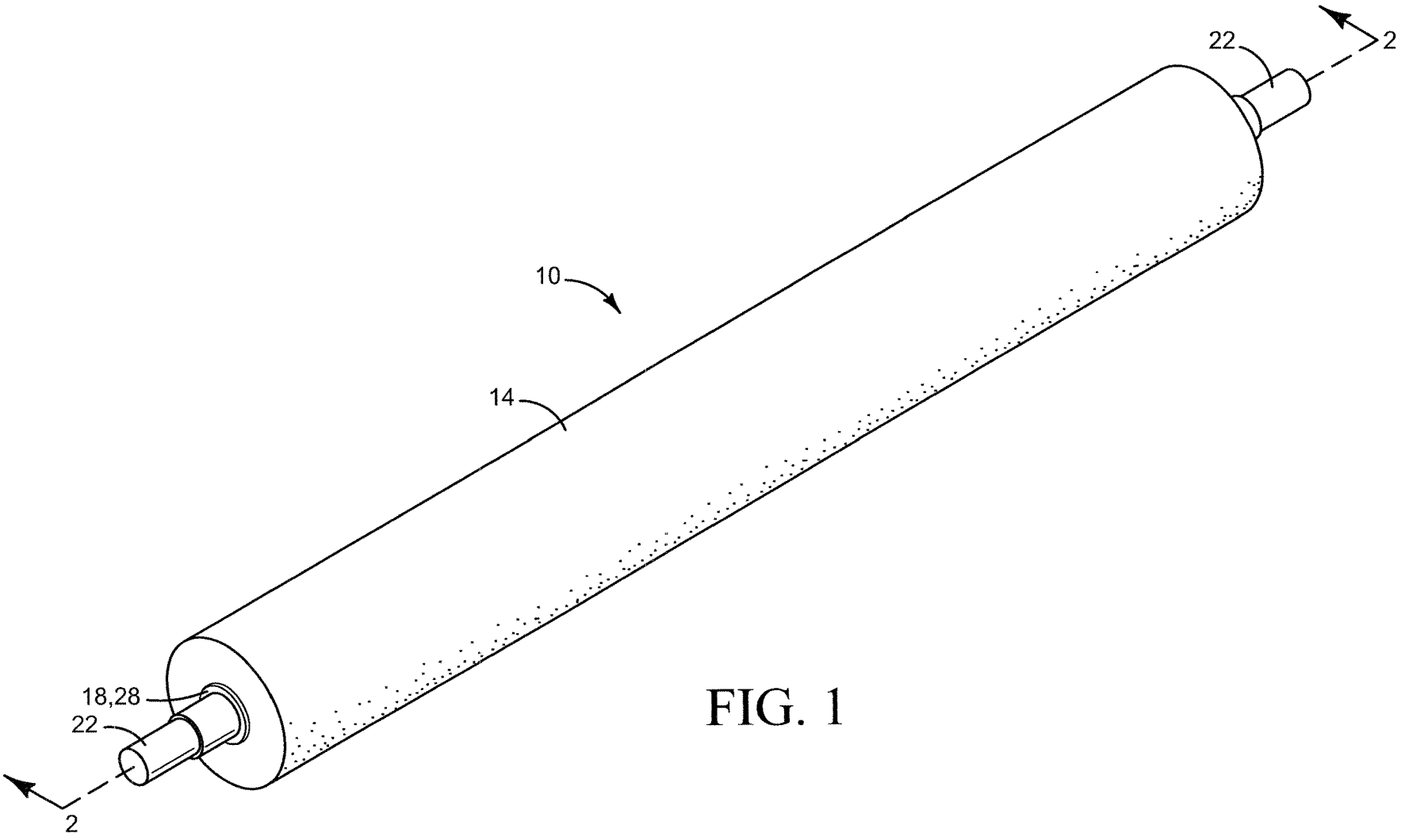
FIG. 1 is an isometric view illustrating one example of a developer roller for liquid electrophotographic printing.
Figure 2:
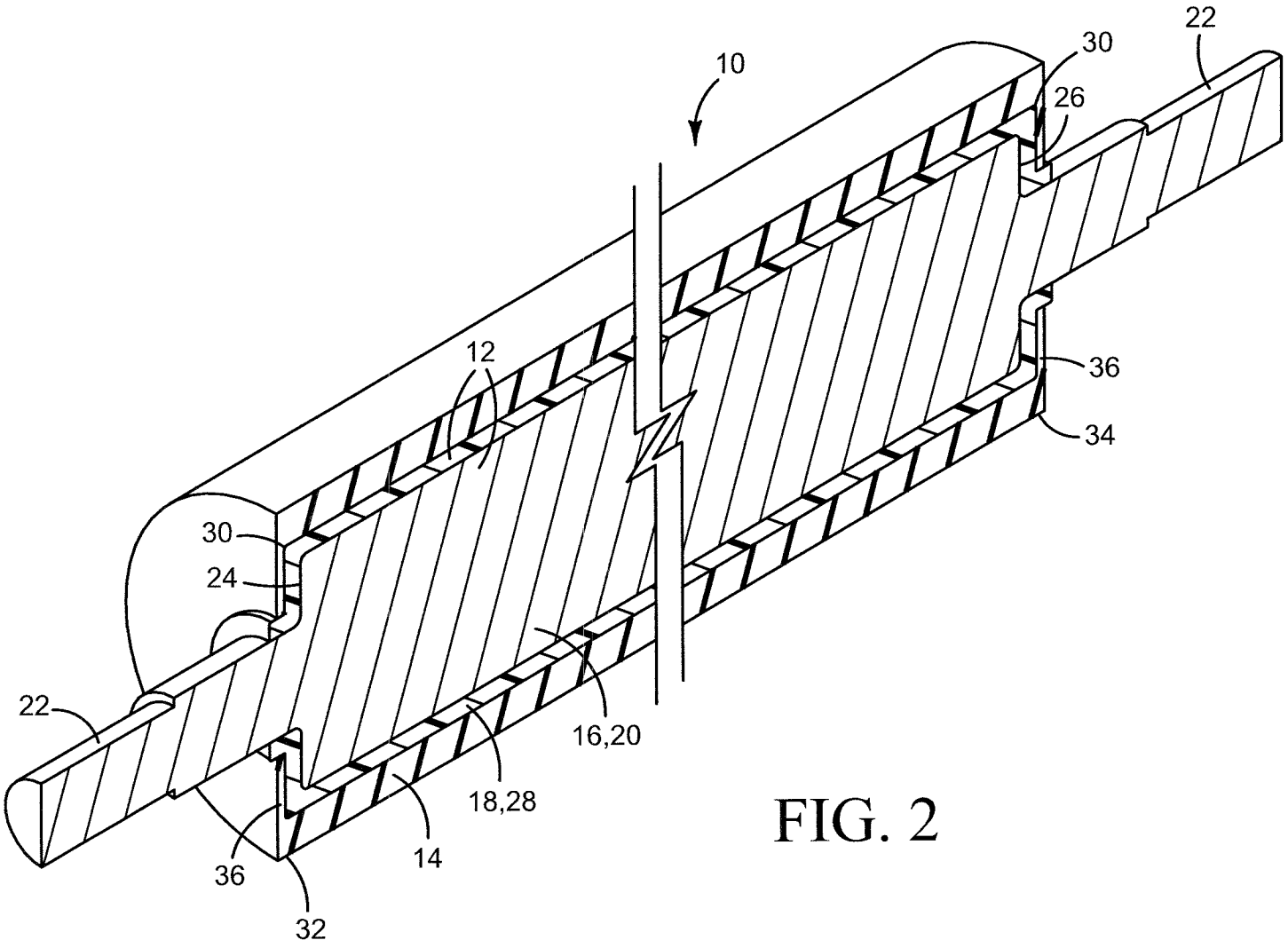
FIG. 2 is an isometric section view taken along the line 2-2 in FIG. 1.
Figure 3:
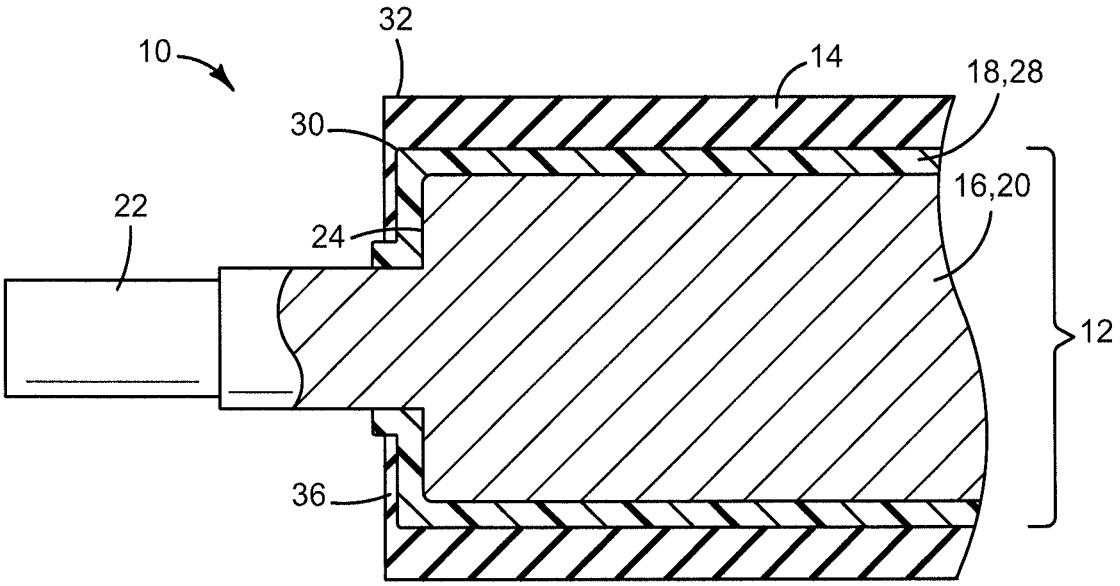
FIG. 3 is a partial section view showing one end of the example roller of FIGS. 1 and 2 in more detail.

FIG. 1 illustrates one example of a developer roller 10 for liquid electrophotographic printing. FIG. 2 is an isometric section taken along the line 2-2 in FIG. 1. FIG. 3 is a partial section showing one end of roller 10 in more detail. Referring to FIGS. 1-3, roller 10 includes a rigid conductive core 12 and a compliant resistive exterior 14 surrounding core 12. Core 12 includes a cylindrical metal inner core 16 and a rigid conductive plastic outer core 18 surrounding inner core 16. In this example, outer core 18 is formed directly on inner core 16 with no intervening materials, to help provide a good electrical connection between inner and outer cores 16, 18 and to help maintain the desired mechanical rigidity of core 12. Also in this example, compliant exterior 14 is formed directly on outer core 18 to help reduce the risk of detachment. While it may be possible in some implementations to include intervening materials, adhesives for example, it is expected that usually it will be desirable to avoid intervening materials for better mechanical and electrical performance.

Figure 4:
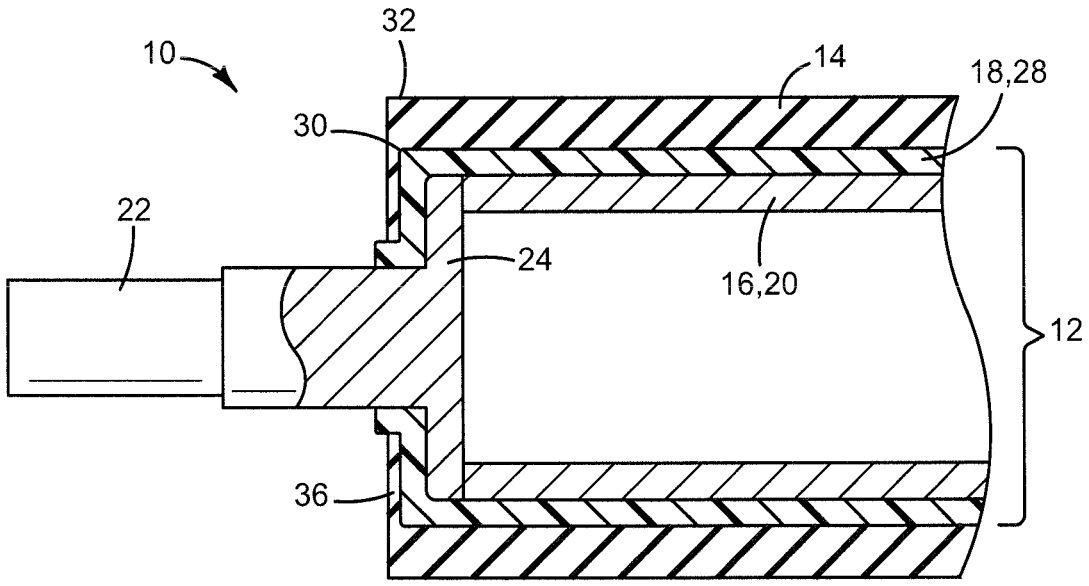
FIG. 4 is a partial section view illustrating another example of a developer roller for liquid electrophotographic printing.

A conductive core 12 provides the operating voltage to exterior 14 during printing. Thus, the resistivity of outer core 18 should be low and the electrical conductivity between inner core 16 and outer core 18 should be high. Outer core 18 should also provide a good adhesive base for exterior 14. Although any suitably rigid conductive plastic may be used, it is expected that a carbon filled plastic cast, molded or otherwise formed directly on core 12 will provide the desired conductivity and mechanical rigidity for many liquid electrophotographic printing applications. In the example shown in FIGS. 1-3, inner core 16 is configured as a solid aluminum or other suitable metal cylinder 20 with integral shafts 22 at each end 24, 26. In the example shown in FIG. 4, inner core 16 is configured as a hollow steel or other suitable metal cylinder 20 with shafts 22 on discrete end plates attached to cylinder 20. Outer core 18 is configured as a hard plastic shell 28 surrounding cylinder 20 and covering each end 24, 26. Exterior 14 covers shell 28. Thus, a polyurethane exterior 14 does not contact a metal inner core 16.

A hard plastic shell 28 formed around a cylindrical inner core 16 allows a comparatively sharp corner 30 at each end 24, 26 of inner core cylinder 20. For example, a polyurethane exterior 14 may be formed securely on a carbon fiber filled polyphenylene sulfide (PPS) outer core 18 around a corner 30 with a radius of 0.5 mm, as shown in FIGS. 1-4, compared to a corner radius of at least 2.0 mm for a polyurethane exterior formed directly around a metal core. A smaller radius at corner 30 enables a stronger electric field at each end 32, 34 to extend the usable length of roller 10. A smaller radius at corner 30 also enables a thinner polyurethane wrap 36 at each end 32, 34. For example, a polyurethane exterior 14 with a 0.5 mm thick wrap 36 may be used in the configurations shown in FIGS. 1-4 compared to a 3.0 mm thick wrap used to secure a polyurethane exterior formed directly on a metal core with a larger radius corner. In some implementations, it may be desirable to completely eliminate an end wrap 36, truncating exterior 14 at or near the end of outer core 18.

Although any suitably compliant resistive material may be used for exterior 14, it is expected that a polyurethane exterior 14 exhibiting a resistivity of at least 0.5 MΩ-cm will be suitable for many liquid electrophotographic printing applications to match the properties of the exterior on existing developer rollers. Similarly, although any suitable rigid conductive plastic may be used for outer core 16, it is expected that a carbon filled PPS, polycarbonate, polyamide, or polyetherimide exhibiting a resistivity below 1.0 kΩ-cm will enable performance comparable to existing developer rollers, for seamless integration into existing LEP printers and LEP printing processes. For example, testing shows that an outer core 18 made of PPS filled with about 50% carbon fibers by weight, exhibiting a resistivity below 1000-cm, cast directly around a solid cylindrical aluminum inner core 14 provides the mechanical and electrical characteristics that enable performance comparable to existing developer rollers with a solid metal core.

The interface between a rigid plastic carbon filled core 18 and a polyurethane exterior 14 is more stable than a metal-to-polyurethane interface, reducing the risk of depolymerization that can cause reversion spots or staining during storage. A plastic core 18 also reduces or eliminates the need for electroless nickel plating a metal core 16, thus lowering cost, while improving adhesion between the polyurethane exterior and the core.

Figure 5:
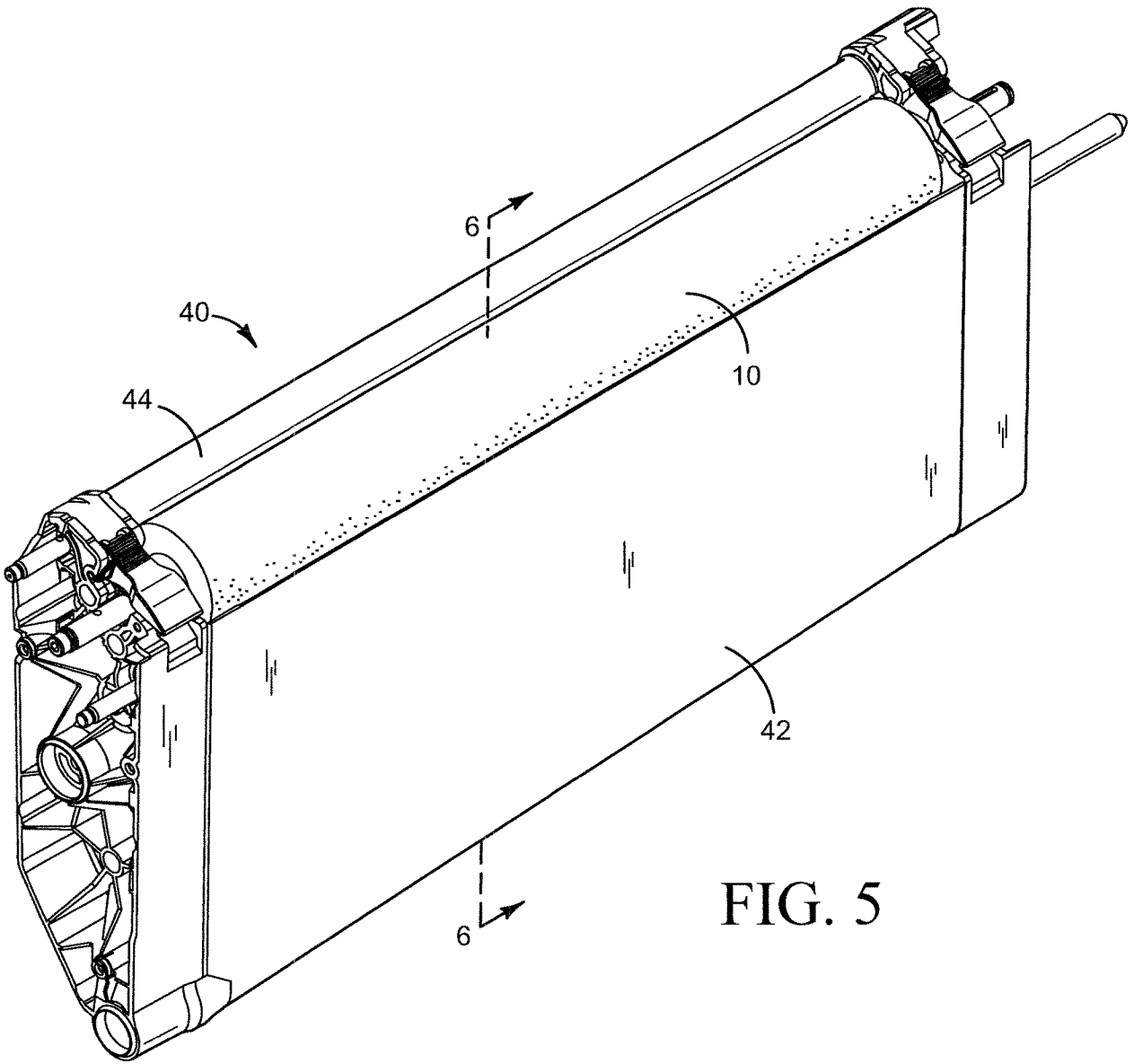
FIG. 5 is an isometric view illustrating a developer unit for liquid electrophotographic printing implementing the example developer roller shown in FIGS. 1-3.
Figure 6:
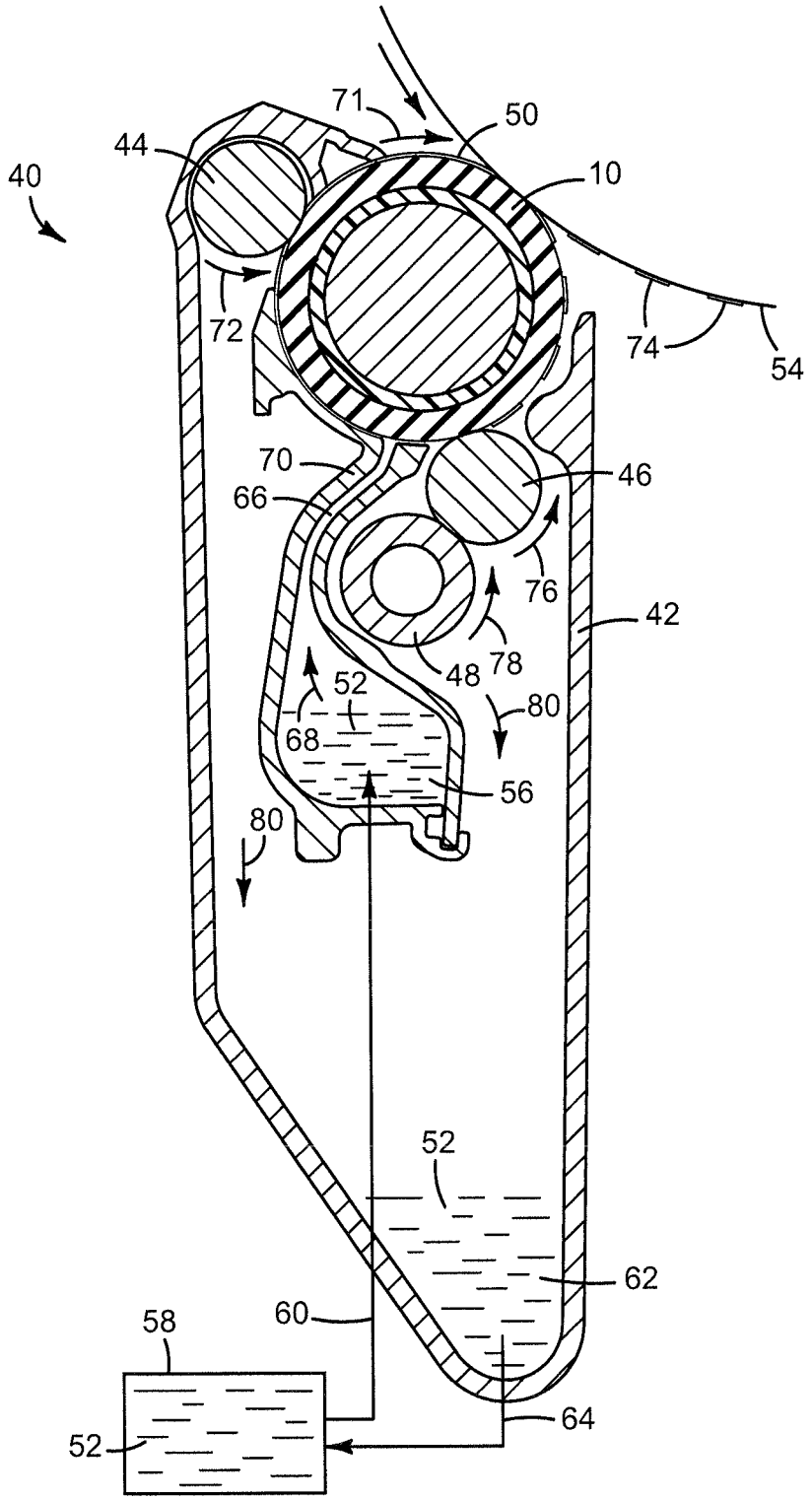
FIG. 6 is a section view taken along the line 6-6 in FIG. 5.

FIG. 5 is an isometric view illustrating a developer unit 40 for a liquid electrophotographic printer, implementing the example developer roller 10 shown in FIGS. 1-3. FIG. 6 is a section view taken along the line 6-6 in FIG. 5. A developer unit for an LEP printer is commonly referred to as a "binary ink developer" or a "BID." An LEP printer may include multiple BIDs, one for each color ink for example.

Referring to FIGS. 5 and 6, developer unit 10 includes a housing 42 housing developer roller 10, a squeegee roller 44, a cleaner roller 46, and a sponge roller 48. Developer roller 10 is exposed outside housing 12 to present a film 50 of LEP ink 52 to a photoconductor 54 as shown in FIG. 6. LEP ink 52 may be pumped to a local supply chamber 56 in developer unit 10 from an external reservoir 58 through an inlet 60, as shown diagrammatically in FIG. 6. Also, excess ink 52 may be reclaimed and collected in a local return chamber 62 and returned to reservoir 58 through an outlet 64.

Referring specifically to FIG. 6, in operation, according to one example, supply chamber 56 is pressurized to force ink 52 up through a channel 66 to the electrically charged developer roller 10, as indicated by flow arrow 68. A thin layer of ink is applied electrically to the surface of a rotating developer roller 10 along an electrode 70. A voltage difference between developer roller 10 and electrode 70 causes charged particles in the LEP ink to adhere to roller 10. Squeegee roller 44 is also charged to a different voltage than developer roller 10. Squeegee roller 44 rotates along developer roller 10 to squeegee excess carrier liquid from the ink on roller 10 while charged particles in the ink continue to adhere developer roller 10. In the example shown, developer roller 10 is rotated clockwise (arrow 71) and squeegee roller 44 is rotated counterclockwise (arrow 72) so that the surfaces move in the same direction at the interface between rollers 10 and 44.

The now more concentrated ink film 50 on developer roller 10 is presented to photoconductor 54 where some of the ink is transferred in the pattern of a latent electrostatic image on the photoconductor, as the desired ink image 74. A charged cleaner roller 46 rotates along developer roller 10 to electrically remove residual ink from roller 10. In the example shown, cleaner roller 46 is rotated counterclockwise (arrow 76) so that the surfaces move in the same direction at the interface between rollers 10 and 46. In this example, cleaner roller 46 is scrubbed with a so-called "sponge" roller 48 that is rotated against cleaner roller 46. In the example shown, sponge roller 48 is rotated counterclockwise (arrow 78) so that the surfaces move in opposite directions at the interface between rollers 46 and 48. Some of the ink residue may be absorbed into sponge roller 48 and some may fall away. Ink is removed from sponge roller 48 through contact with the chamber wall and/or with a squeezer roller (not shown). Excess carrier liquid and ink drains to return chamber 62, as indicated by flow arrows 80, where it can be recycled to reservoir 58.

As noted above, the examples shown in the figures and described herein illustrate but do not limit the scope of the patent, which is defined in the following Claims.

"A", "an" and "the" used in the claims means one or more.

The invention claimed is:

1. A developer roller for liquid electrophotographic printing, comprising:
   - a conductive cylinder having a cylindrical surface, a first end distinct from and intersecting the cylindrical surface, and a second end distinct from and intersecting the cylindrical surface opposite the first end;
   - a compliant exterior around the cylindrical surface to present a film of liquid electrophotographic ink to a photoconductor during printing; and
   - rigid conductive plastic sandwiched between the cylindrical surface and the exterior and covering the first and second ends of the cylinder.

2. The roller of claim 1, where the plastic has a resistivity below 100Ω -cm.

3. The roller of claim 2, where the exterior comprises a resistive exterior having a resistivity of at least 0.5MΩ-cm.

4. The roller of claim 1, where the plastic comprises a carbon filled plastic.

5. The roller of claim 4, where the carbon fill includes carbon fibers.

6. The roller of claim 1, where the exterior covers at least some of each end of the plastic covering respective first and second ends of the cylinder.

7. The roller of claim 6, comprising a shaft extending axially from each end of the cylinder through the plastic such that there is plastic between each shaft and the exterior.

8. A developer roller for liquid electrophotographic printing, comprising:

a multi-part rigid conductive core that includes a cylindrical metal inner core and a rigid conductive plastic outer core surrounding the inner core; and a resistive compliant exterior surrounding the outer core.

9. The roller of claim 8, where:

the outer core is formed directly on the inner core; and the exterior is formed directly on the outer core.

10. The roller of claim 9, where:

the outer core is a layer of carbon filled plastic on the inner core; and the exterior is a layer of polyurethane on the layer of carbon filled plastic.

11. The roller of claim 10, where:

the inner core includes a cylindrical surface, a first end distinct from and intersecting the cylindrical surface, and a second end distinct from and intersecting the cylindrical surface opposite the first end;

the layer of carbon filled plastic covers the first and second ends of the inner core; and the polyurethane exterior wraps around each end of the layer of carbon filled plastic covering respective first and second ends of the inner core.

12. The roller of claim 11, comprising a shaft extending axially from each end of the inner core through the layer of carbon filled plastic such that there is carbon filled plastic between each shaft and the polyurethane exterior.

13. A developer unit for a liquid electrophotographic printer, comprising:

a developer roller to present LEP ink to a photoconductor; and a squeegee roller to squeegee ink on the developer roller;

the developer roller including a multi-part rigid conductive core that includes:

a cylindrical metal inner core and a rigid conductive plastic outer core surrounding the inner core; and a resistive compliant exterior surrounding the outer core.

14. The developer unit of claim 13, where:

the outer core is a carbon filled plastic on the inner core; and the exterior is a polyurethane on the outer core.

* * * * *